US012031395B2

(12) United States Patent
Al-Huwaider et al.

(10) Patent No.: US 12,031,395 B2
(45) Date of Patent: Jul. 9, 2024

(54) DETECTING A KICK IN A WELLBORE

(71) Applicant: Saudi Arabian Oil Company, Dhahran (SA)

(72) Inventors: Mustafa A. Al-Huwaider, Dhahran (SA); Shouxiang Mark Ma, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 22 days.

(21) Appl. No.: 17/929,590

(22) Filed: Sep. 2, 2022

(65) Prior Publication Data

US 2024/0076945 A1 Mar. 7, 2024

(51) Int. Cl.
*E21B 21/08* (2006.01)

(52) U.S. Cl.
CPC ..... *E21B 21/08* (2013.01)

(58) Field of Classification Search
CPC ..... E21B 21/08
See application file for complete search history.

(56) References Cited

U.S. PATENT DOCUMENTS 4,980,642 A * 12/1990 Rodney ..... E21B 47/113 73/152.21
5,214,251 A 5/1993 Orban et al.
5,495,237 A * 2/1996 Yuasa ..... E21B 47/13 340/854.6
5,551,287 A 9/1996 Maute et al.
8,919,209 B2 12/2014 Furlong
9,938,820 B2 4/2018 Bonavides et al.
10,920,579 B2 2/2021 Beaman, Jr. et al.
2005/0150690 A1* 7/2005 Moriarty ..... E21B 7/068 175/57
2012/0170406 A1* 7/2012 DiFoggio ..... G01N 29/024 367/35
2013/0090855 A1* 4/2013 Rasmus ..... E21B 34/06 702/9
2019/0186258 A1* 6/2019 Niu ..... E21B 47/095

OTHER PUBLICATIONS

Elahifar et al., "Real Time Kick Detection and Also Increasing Ultrasonic Caliper Accuracy by Measuring Speed Sound within Drilling Fluid in the Downhole Condition," SPE Annual Technical Conference and Exhibition, Oct. 2014, 5 pages.

(Continued)

*Primary Examiner* — Dany E Akakpo
(74) *Attorney, Agent, or Firm* — Fish & Richardson P.C.

(57) ABSTRACT

Systems and methods for detecting a formation fluid kick in a wellbore include drilling into a subsurface formation using a drill string including a pup joint. Measuring properties of a drilling fluid inside of the drill string at the pup joint using a first sensor module and measuring properties of the drilling fluid outside of the drill string at the pup joint using a second sensor module. Analyzing the measured properties of the drilling fluid inside and outside of the drill string at the pup joint including calculating a difference between the properties of the drilling fluid inside and outside of the drill string at the pup joint. Determining an occurrence of the kick based on the difference between the properties of the drilling fluid inside and outside of the drill string at the pup joint exceeding a pre-determined threshold value.

20 Claims, 8 Drawing Sheets

(56) References Cited

OTHER PUBLICATIONS

Elahifar et al., "Wellbore Instability Monitoring by Using 4D Imaging of Ultrasonic Caliper Logs in Real Time Drilling," International Petroleum Technology Conference, Mar. 2013, 8 pages.
Fraser et al., "Early Kick Detection Methods and Technologies," SPE Annual Technical Conference and Exhibition, Oct. 2014, 7 pages.
Huque et al., "Kick Detection and Remedial Action in Managed Pressure Drilling: A review," SN Applied Sciences, Jun. 2020, 2:1178, 29 pages.
Nayeem, "Monitoring of Down-hole Parameters for Early Kick Detection," Thesis for the degree of Master of Engineering, Memorial University of Newfoundland, May 2016, 111 pages.
wikipedia.com [online], "Darvaza Gas Crater," Apr. 2022, retrieved on May 3, 2022, retrieved from URL <https://en.wikipedia.org/wiki/Darvaza_gas_crater>, 4 pages.

* cited by examiner

DETECTING A KICK IN A WELLBORE

TECHNICAL FIELD

The present disclosure generally relates to drilling tools and operations for forming a wellbore, more particularly systems, tools, and methods that can be used to detect a kick in a wellbore.

BACKGROUND

Safe drilling operations are usually conducted overbalanced (i.e., with the bottom hole hydrostatic pressure ($P_{hyd}$) greater than the formation pressure ($P_{fm}$)). To minimize formation damage caused by drilling fluid invasion into the formation, it is desirable to minimize the pressure differences between $P_{hyd}$ and $P_{fm}$, one of the main justifications for balanced-pressure drilling. In some instances (e.g., when drilling into an unfamiliar formation with overpressure zones), a kick can occur. In the drilling operations, a kick (i.e., an unexpected and unwanted influx of reservoir fluids; oil, water, or gas, into the wellbore due to an underbalanced condition in which $P_{hyd}$, the pressure inside the wellbore or bottom-hole pressure (BHP), is less than $P_{fm}$, the formation pressure) can occur. Kicks can damage wells and, in some instances, can lead to a well blowout, a condition hazardous and dangerous to the people working on and near the rig and rig site, the surrounding environment, and equipment and facilities at and near the rig site.

SUMMARY

This specification describes systems, tools, and methods for monitoring and detecting a kick in a wellbore, during drilling. The systems include one or more sensor-equipped pup joints deployed along a downhole tubular (e.g., in a drill string) deployed in a wellbore, while drilling. Each pup joint includes a body, two sensor modules (e.g., a first sensor module and a second sensor module), a power source, a communication device, and a processor. The body of the pup joint has threads used to attach the pup joint to other components of the drill string during drilling to access a subterranean zone.

Drilling fluid (e.g., water-based muds (WBMs), oil-based muds (OBMs), and gaseous drilling fluids) is used during drilling operations to lubricate and drive a drill, cool downhole equipment, and carry drilled formation cuttings out of the wellbore. The drilling fluid flows downhole through the drill string, out through the drill bit, and uphole in an annulus between the drill string and walls of the wellbore. The one sensor module measures parameters (e.g., pressure, temperature, resistivity, dielectric constant, density, or acoustic velocity) indicative of the properties of the drilling fluid inside the drill string at the pup joint. Another sensor module measures parameters (e.g., pressure, temperature, resistivity, dielectric constant, density, or acoustic velocity) indicative of properties of the drilling fluid outside the drill string at the pup joint (e.g., in the annulus). In some implementations, the first sensor module is embedded within an inner surface of the body of the pup joint. In some implementations, the second sensor module is embedded within an outer surface of the body of the pup joint. Each pup joint can include sensors, instrumentation and signal processing circuits, receivers, transmitters, connecting probes, and data storing and processing devices.

The monitoring approach can detect an oil kick, a gas kick, a hot water kick (such as in drilling geothermal wells), or all kicks based on a comparison of a difference between the inside and outside properties of the drilling fluid of the drill string at the pup joint and pre-determined threshold values indicating stable wellbore conditions. In event of a kick, pre-determined threshold values can be reached or crossed and the system aboard the pup joint sends an alert to the user indicating a possible formation fluid kick. For example, when at least two or three pre-determined threshold values for consecutive pup joints are reached and crossed, a hydrocarbon kick is likely confirmed.

When multiple pup joints are used, the pup joints are configured to communicate with each other (e.g., using a positive pulse signal valve). Each pup joint includes an internal pressure sensor and, when transferring data to the surface and/or commands downhole, one pup joint can activate the next pup joint by sending a specific pulse that is unique to the next pup joint. The described sensing configuration with multiple pup joints can monitor and detect the kick in the wellbore in real-time (e.g., the duration between receiving input and processing the input to provide an output can be minimal, for example, in the order of seconds or less).

Installing multiple sensor modules in each pup joint along the drill string helps to monitor the wellbore profile in real-time and allows drilling engineers to monitor and detect formation fluids kicks quickly. The presence of gas (for example, natural gas) or crude oil in drilling fluids can be indicative of potentially disastrous events with costly consequences. Early detection of gas or crude oil in drilling fluids can prevent the onset and occurrence of such events and help increase drilling safety.

Methods for detecting a formation fluids kick in a wellbore can include: drilling into a subsurface formation using a drill string including a pup joint; measuring properties of a drilling fluid inside of the drill string at the pup joint using a first sensor module; measuring properties of the drilling fluid outside of the drill string at the pup joint using a second sensor module; calculating a difference between the properties of the drilling fluid inside and outside of the drill string at the pup joint; determining an occurrence of the kick based on the difference between the properties of the drilling fluid inside and outside of the drill string at the pup joint exceeding a pre-determined threshold value; and increasing a mud weight of the drilling fluid pumped into the wellbore responsive to the determined kick in the wellbore.

Pup joints can include: a body configured to be disposed within a wellbore formed in a subterranean formation and having an inner surface defining a flow passage and an outer surface defining an annulus; a first sensor module mounted on the body and operable to measure properties of a drilling fluid inside of the pup joint; a second sensor module mounted on the body and operable to measure properties of a drilling fluid outside of the pup joint; a power source disposed inside the pup joint; a communication device communicatively connected to the first sensor module and the second sensor module and disposed inside the pup joint; and a processor connected to the communication device and the power source and disposed inside the pup joint, the processor operable to perform: calculating a difference between the properties of the drilling fluid inside and outside of the pup joint; determining an occurrence of a kick based on the difference between the properties of the drilling fluid inside and outside of the pup joint exceeding a pre-determined threshold value; and increasing a mud weight of the drilling fluid pumped into the wellbore responsive to the determined kick in the wellbore.

Systems for detecting a kick in a wellbore can include: a drill string; a plurality of pup joints attached to the drill string and communicatively coupled to one another using a pulse signal valve, wherein each of the plurality of pup joints comprises: a body; a first sensor module embedded within an inner surface of the body and operable to measure properties of a drilling fluid inside of the drill string at the pup joint; a second sensor module embedded within an outer surface of the body and operable to measure properties of a drilling fluid outside of the drill string at the pup joint; a power source; a communication device communicatively connected to the first sensor module and the second sensor module; and a processor connected to the communication device and the power source, the processor operable to perform: calculating a difference between the properties of the drilling fluid inside and outside of the drill string at the pup joint; determining an occurrence of the kick based on the difference between the properties of the drilling fluid inside and outside of the drill string at the pup joint exceeding a pre-determined threshold value; and automatically increasing a mud weight of the drilling fluid pumped into the wellbore responsive to the determined kick in the wellbore; and an electronic control and processing system connected to the processor in each of the plurality of pup joints, wherein the electronic control and processing system is configured to update a drilling plan and to change the weight of mud pumped into the wellbore responsive to the determined kick in the wellbore.

These devices and methods can include one or more of the following features.

Some methods also include transmitting data of the determined kick in the wellbore uphole to a surface system for controlling drilling operations.

In some devices and methods, the drill string includes a plurality of pup joints, and determining the occurrence of the kick comprises determining the occurrence of the kick based on the difference between the properties of the drilling fluid inside and outside of the drill string exceeding the pre-determined threshold value at the plurality of the pup joints.

Some methods also include calculating a difference of a mud return density at each depth from a plurality of depths taken from an Earth's surface to a bottom of the wellbore. In some cases, the methods also include comparing the difference between mud return densities at each depth with a pre-determined, designed mud based, density threshold value.

In some devices and methods, the first sensor module includes a first resistivity sensor and the second sensor module includes a second resistivity sensor, and measuring properties of the drilling fluid comprises measuring resistivity of the drilling fluid inside or outside of the drill string at the pup joint using the first resistivity sensor or the second resistivity sensor.

In some devices and methods, the first sensor module includes a first ultrasound sensor and the second sensor module includes a second ultrasound sensor, wherein measuring properties of the drilling fluid comprises measuring acoustic velocity of the drilling fluid inside or outside of the drill string at the pup joint using the first ultrasound sensor or the second ultrasound sensor.

In some methods, measuring properties of the drilling fluid comprises measuring resistivity and acoustic velocity of the drilling fluid inside or outside of the drill string at the pup joint.

In some methods, determining the occurrence of the kick comprises determining a gas kick in the wellbore when a pressure increase inside and outside of the drill string at the pup joint is greater than a pre-determined pressure threshold value, and a temperature difference between the temperature of the drilling fluid inside and outside of the drill string at the pup joint is greater than a pre-determined temperature threshold value for the temperature of the drilling fluid outside of the drill string being greater than the temperature of the drilling fluid inside of the drill string. In some cases, determining the occurrence of the kick comprises determining the gas kick in the wellbore when a resistivity difference between the resistivity of the drilling fluid inside and outside of the drill string at the pup joint is greater than a pre-determined resistivity threshold value for the resistivity of the drilling fluid outside of the drill string being greater than the resistivity of the drilling fluid inside of the drill string, wherein the drilling fluid is a water-based mud. In some cases, determining the occurrence of the kick comprises determining the gas kick in the wellbore when an absolute value of a resistivity difference between the resistivity of the drilling fluid inside and outside of the drill string at the pup joint is approaching to zero for the resistivity of the drilling fluid outside of the drill string being similar to the resistivity of the drilling fluid inside of the drill string, wherein the drilling fluid is an oil-based mud.

In some methods, determining the occurrence of the kick comprises determining the gas kick in the wellbore when an absolute value of an acoustic velocity difference between the velocity of the drilling fluid inside and outside of the drill string at the pup joint is greater than a pre-determined velocity threshold value for the velocity of the drilling fluid outside of the drill string being lower than the velocity of the drilling fluid inside of the drill string, and an absolute value of a density difference between the density of the drilling fluid inside and outside of the drill string at the pup joint is greater than a pre-determined density threshold value for the density of the drilling fluid outside of the drill string being lower than the density of the drilling fluid inside of the drill string.

In some methods, determining the occurrence of the kick comprises determining an oil kick in the wellbore when a pressure increase inside and outside of the drill string at the pup joint is greater than a pre-determined pressure threshold value, and a temperature difference between the temperature of the drilling fluid inside and outside of the drill string at the pup joint is greater than a pre-determined temperature threshold value for the temperature of the drilling fluid outside of the drill string being greater than the temperature of the drilling fluid inside of the drill string. In some cases, determining the occurrence of the kick comprises determining the oil kick in the wellbore when a resistivity difference between the resistivity of the drilling fluid inside and outside of the drill string at the pup joint is greater than a pre-determined resistivity threshold value for the resistivity of the drilling fluid outside of the drill string being greater than the resistivity of the drilling fluid inside of the drill string, wherein the drilling fluid is a water-based mud. In some cases, determining the occurrence of the kick comprises determining the oil kick in the wellbore when an absolute value of a resistivity difference between the resistivity of the drilling fluid inside and outside of the drill string at the pup joint is approaching to zero for the resistivity of the drilling fluid outside of the drill string being similar to that of the drilling fluid inside of the drill string, wherein the drilling fluid is an oil-based mud. In some cases, determining the occurrence of the kick comprises determining the crude oil kick in the wellbore when an acoustic velocity difference between the velocity of the drilling fluid inside and outside of the drill string at the pup joint is approaching zero for the acoustic velocity of the drilling fluid outside of the drill string being only slightly slower than or similar to the velocity of the drilling fluid inside of the drill string (acoustic velocity for a typical oil is around 4,200 ft/s, while for water ranges from 4,600 ft/s to 5,300 ft/s), and an absolute value of a density difference between the density of the drilling fluid inside and outside of the drill string at the pup joint is greater than a pre-determined density threshold value for the density of the drilling fluid outside of the drill string being smaller than the density of the drilling fluid inside of the drill string. In some cases, determining the occurrence of the kick in the wellbore comprises determining a saturated crude oil kick or an under-saturated crude oil kick or both.

The systems, tools, and methods described in this specification provide an approach where concurrently operating sensors from two sensor modules can monitor the wellbore and can detect kicks with increased accuracy. Alerting the user in real-time when determining early warning signs in well control increases wellbore safety. Careful observance and positive reaction to these signs can keep the well under control and reduce the likelihood of a well blowout.

The described tools, systems, and methods can help continuously monitor the wellbore conditions in real-time and eliminate the need for surface calibration and physical sampling of the wellbore fluids in separate chambers. The described approach operates without the need for additional equipment parts (e.g., pistons, valves, or heaters) and simplifies the drilling operations. The described approach provides economic advantages by eliminating the cost and time needed to add extra elements to the drilling equipment and to sample drilling fluids for evaluation of the wellbore condition. These factors can result in improved and efficient drilling operations at a reduced operating time.

The details of one or more embodiments of these systems and methods are set forth in the accompanying drawings and the description below. Other features, objects, and advantages of these systems and methods will be apparent from the description, drawings, and claims.

DESCRIPTION OF DRAWINGS

FIGS. 3A-6C are example charts of measured properties of a drilling fluid inside and outside of the pup joint.

DETAILED DESCRIPTION

This specification describes systems, tools, and methods for monitoring and detecting a kick in a wellbore. The systems include one or more sensor-equipped pup joints deployed along a downhole tubular (e.g., in a drill string) deployed in a wellbore. Each pup joint includes a body, two sensor modules (e.g., a first sensor module and a second sensor module), a power source, a communication device, and a processor. The body of the pup joint has threads used to attach the pup joint to other components of the drill string during drilling to access a subterranean zone.

The one sensor module measures parameters (e.g., pressure, temperature, resistivity, dielectric constant, density, or acoustic velocity) indicative of the properties of the drilling fluid inside the drill string at the pup joint. Another sensor module measures parameters (e.g., pressure, temperature, resistivity, dielectric constant, density, or acoustic velocity) indicative of properties of the drilling fluid outside the drill string at the pup joint (e.g., in the annulus). In some implementations, the first sensor module is embedded within an inner surface of the body of the pup joint. In some implementations, the second sensor module is embedded within an outer surface of the body of the pup joint. Each pup joint can include sensors, instrumentation and signal processing circuits, receivers, transmitters, connecting probes, and data storing and processing devices.

The monitoring approach can detect an crude oil kick, a gas kick, a hot water kick, or all kicks based on a comparison of a difference between the inside and outside properties of the drilling fluid of the drill string at the pup joint and pre-determined threshold values indicating stable wellbore conditions. In event of a kick, pre-determined threshold values can be reached or crossed and the system aboard the pup joint sends an alert to the user indicating possibility of a formation fluid kick. For example, when at least two or three pre-determined threshold values for consecutive pup joints are reached or crossed a kick may be confirmed, and actions such as mud-up the drilling fluid, i.e., increase drilling fluid density, may be taken to ensure drilling safety.

Figure 1:
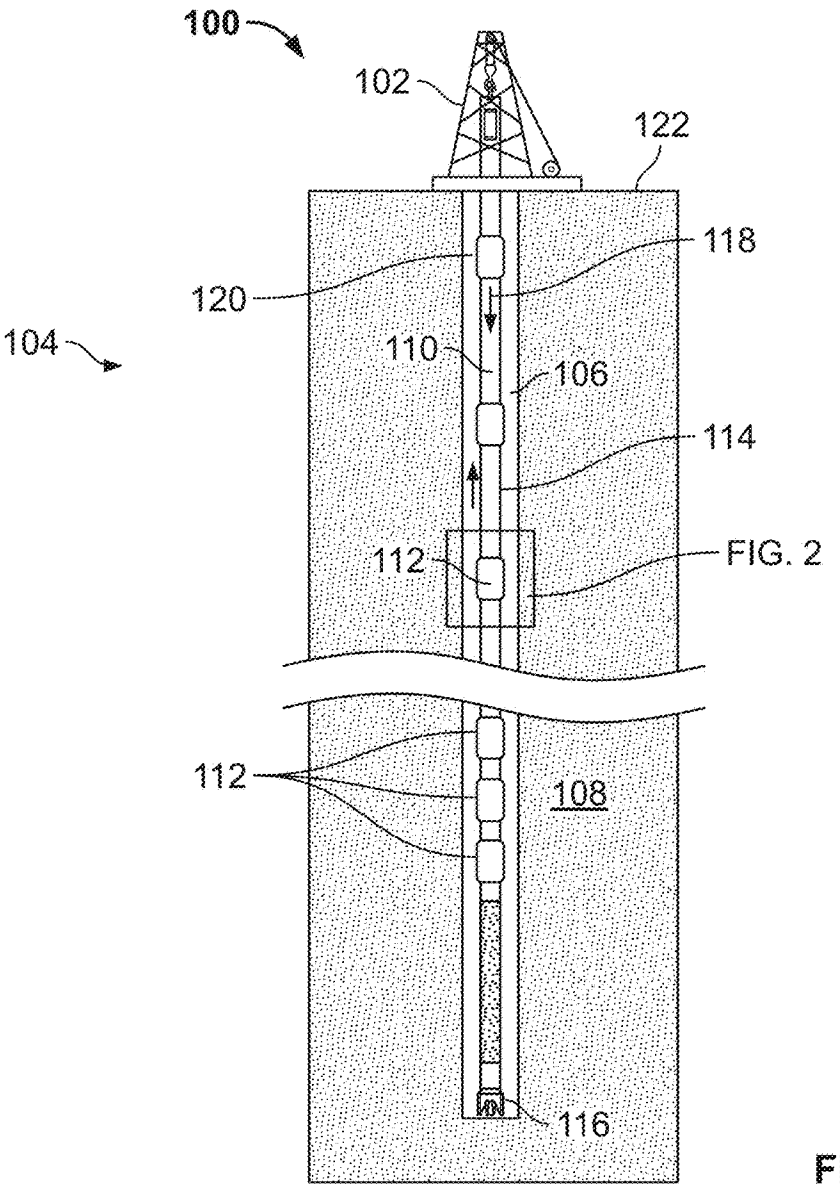
FIG. 1 is a schematic view of drilling into a subsurface formation using a drilling assembly including a drill string with multiple pup joints.

FIG. 1 is a schematic view of drilling into subsurface formation 108 using a drilling assembly 100 including a drill string 110 with multiple pup joints 112. The drilling assembly 100 includes a derrick 102 that supports a downhole portion 104 of the drilling assembly 100. The drilling assembly 100 is being used to form a wellbore 106 in the formation 108. The downhole portion 104 of the drilling assembly 100 includes a drill string 110 with multiple pup joints 112 connecting sections of the drill string 110 formed by multiple drill pipes 114, and a bottom hole assembly with a drill bit 116 attached at the downhole end of the drill string 110. The illustrated wellbore 106 is a vertical wellbore but the described systems, tools, and methods can also be used, for example, in a deviated wellbore or a horizontal wellbore.

The spacing between pup joints 112 can be optimized based on the likelihood of a particular drilling operation experiencing a kick with relevant factors including, for example, the formation being drilled into, whether the wellbore being formed is straight or deviated, high differential pressure between the wellbore ($P_{hyd}$) and formation pore pressure ($P_{fm}$), the potential for wellbore instability and collapse across certain intervals, and expectations of inefficient hole cleaning. Spacing between pup joints depends on mud circulation rate which is a function of maximum mud pump rate and configuration of borehole geometry and drilling assembly. Depending on criteria used to either maximize drilling bit hydraulic power or maximize jet impact force, the maximum mud circulation rate can be obtained from mud pump specifications or estimated from mud pump horsepower, pump efficiency, and maximum allowed pressure in the downstream drill pipe. For example, with a mud circulation velocity of 2 ft/s in the wellbore-drill pipe annulus, the spacing between the lower pup joints close to the bit may be set at 2 ft with other pup joints farther uphole can have spacing of 250 ft for example. It is noted that the higher the mud circulation velocity, the longer the spacing between pup joints, or the lower the mud circulation velocity, the shorter the spacing between pup joints, to ensure that formation fluid kicks are captured on time (with shorter spacing) with accuracy (with longer spacing).

During drilling operations, a drilling fluid 118 (sometimes referred to as drilling mud) is pumped downhole through the drill string 110 to clean, cool and lubricate drilling bit, remove rock cuttings and transfer them to surface. In some cases, drilling fluids can be used to rotate the drill bit 116. A circulation pump (not shown) draws the drilling fluid 118 from a mud pit (not shown) and pumps the drilling fluid 118 into the drill string 110. Conduits (not shown) provide hydraulic connections between the circulation pump and the drill string 110. The conduits can include hose, pipe, open channels, filters, or combinations of these components capable of handling the desired pressures and flow rates.

The drilling mud 118 (arrows indicating flow direction) is pumped downhole from the mud pits through the drill string 110, and out of the drill bit 116, thus cleaning and cooling the drill bit 116 in the process. The drilling mud 118 then carries the crushed or cut rock ("cuttings") up the annulus 120 formed between the drill string 110 and the sides of the hole 106 being drilled, up through the surface casing, where it emerges back at the surface 122. The drilling fluid 118 is then cleaned to remove cuttings, reconditioned and reused. The circulation of the drilling fluid causes a change in the properties of the drilling fluid and the properties of the drilling fluid inside the drill string (the cleaned and reconditioned mud) differs from the properties of the drilling fluid along the annulus (circulated mud contaminated by cuttings, formation fluids flushed out of cuttings and the near-wellbore formation). For example, the returning fluid along the annulus can contain natural gases or other flammable materials and if they ignite, can pose a risk of a fire or an explosion.

Figure 2:
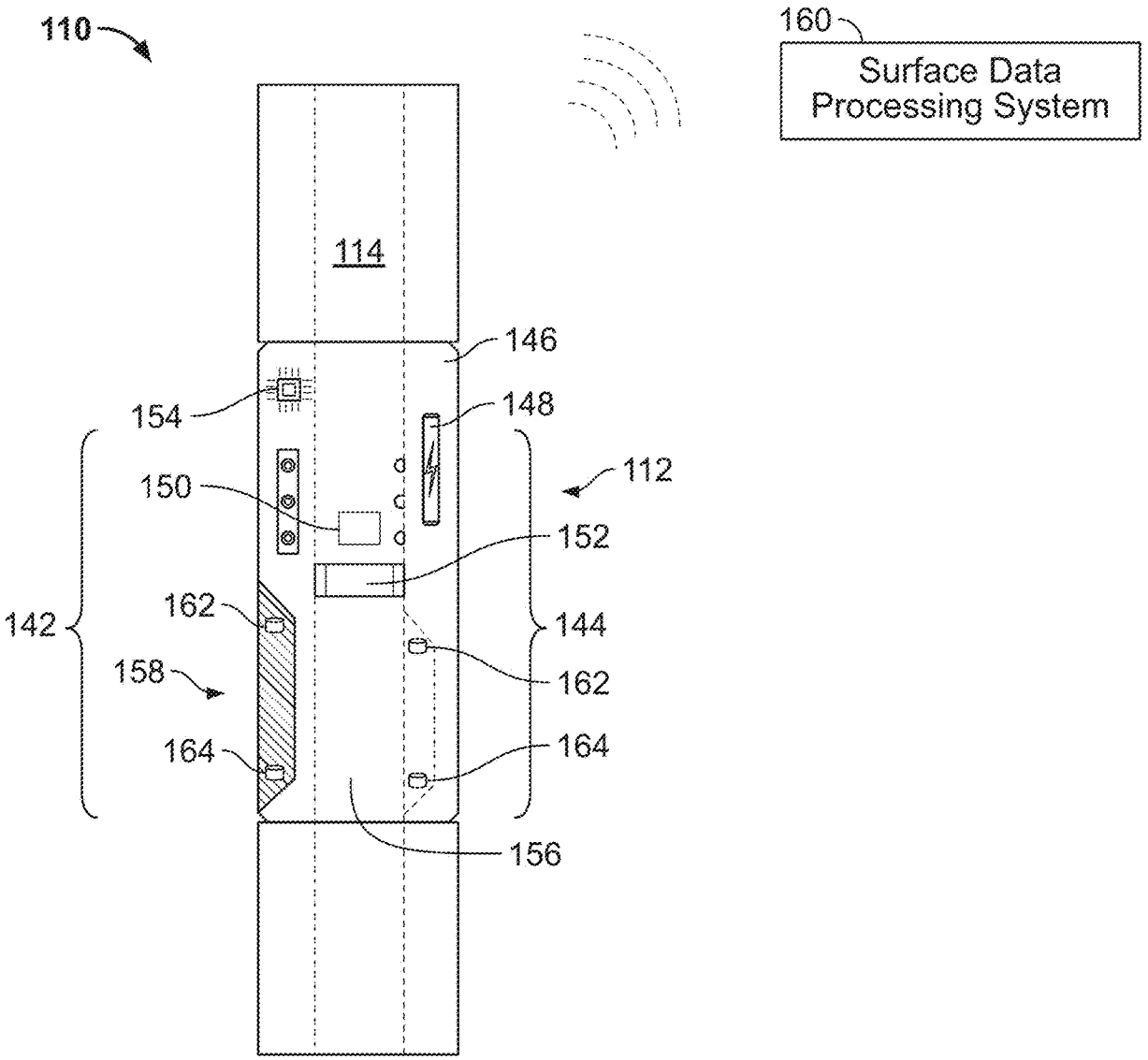
FIG. 2 is a schematic cross-sectional view of an example pup joint including sensor modules.

FIG. 2 is a schematic cross-sectional view of an example pup joint 112 including sensor modules 142 and 144 for monitoring wellbore conditions and detecting kicks in real-time. As illustrated, one of the pup joints 112 is attached to the drill pipe 114. The pup joint 112 includes a body 146, a first sensor module 144, a second sensor module 142, a power source 148, a communication device 150, a pulse signal valve 152, and a processor 154. The body 146 has a cylindrical configuration. The body 146 has threads on each end that attach the body to adjacent drill pipes 114. The body 146 has an inner surface 156 defining a flow passage and an outer surface 158 defining the annulus 120. The cylindrical body 146 includes an internal diameter equal in size to the inner diameter of the drill pipe 114.

The body 146, the first sensor module 144, and the second sensor module 142 are attached. The first sensor module 144 is attached to the inner surface 156 of the cylindrical body 146 inside a recess or a groove. The second sensor module 142 is attached to the outer surface 158 of the cylindrical body 146 inside a recess or a groove. In some implementations, the sensor module 144 is embedded within walls of the body 146 adjacent the inner surface 156. In some implementations, the sensor module 142 is embedded within walls of the body 146 adjacent the outer surface 158 of the body 146. In some implementations, the two sensor modules 142, 144 have different locations. In some implementations, shock absorbers (not shown) are positioned at opposed axial ends of each sensor module 142, 144. The shock absorbers can protect or help protect, the sensors against substantial or excessive force or vibrations (for example, resonance) transmitted by the drill string (for example, drill string 110).

The first sensor module 144 includes sensors to measure the properties of the drilling fluid 118 inside the drill string 110 at the pup joint 112. The sensors include pressure, temperature, resistivity, dielectric constant (capacitor), or ultrasonic sensor to measure parameters (e.g., acoustic velocity) indicative of the properties of the drilling fluid 118 inside the drill string 110 at the pup joint 112. The second sensor module 142 includes sensors to measure properties of the drilling fluid 118 outside the drill string 110 at the pup joint 112. The sensors include pressure, temperature, resistivity, dielectric constant (capacitor), or ultrasonic sensor to measure parameters (e.g., acoustic velocity) indicative of the properties of the drilling fluid 118 outside the drill string 110 at the pup joint 112 (e.g., along the annulus 120).

Each sensor module 142, 144 includes two ultrasonic sensors 162, 164 that are placed in front of each other (e.g., in opposed mode). One ultrasonic sensor 162 serves as a transmitter (e.g., emits the sound using piezoelectric crystals) and the second ultrasonic sensor 164 serves as a receiver (e.g., encounters the sound after it has traveled to and from the target). As the distance between the sensors 162, 164 is fixed the speed of sound can be calculated by measuring the traveling time of the echo from the transmitter 162 to the receiver 164. This sensor arrangement can detect the speed of the sound of the drilling fluid 118 at the pup joint.

The sensor modules 142, 144 can include instrumentation and downhole computing (i.e., signal processing and data interpretation) circuits, receivers, transmitters, connecting probes, and data storing and processing devices. The sensor modules 142, 144 are in electronic communication with the power source 148 (e.g., a chargeable battery), the communication device 150, and the processor 154 of the pup joint 112. In the illustrated pup joints, the processor 154 is operable to receive the measured parameters from each sensor module 142, 144 (e.g., properties of the drilling fluid 118 inside and outside of the drill string 110 at the pup joint 112), calculate a difference between the properties of the drilling fluid 118 inside and outside of the drill string 110 at the pup joint 112, determine the occurrence of the kick based on such as the difference between the properties of the drilling fluid 118 inside and outside of the pup joint 112 and a pre-determined threshold value, and transmit data of the determined kick in the wellbore 106 uphole to a surface system 160 for controlling drilling operations. In some systems, the raw data is transmitted uphole to the surface system 160 rather than being processed onboard individual pup joints.

The pup joint 112 also features a pulse signal valve 152 positioned along the fluid passage. Although the illustrated pulse signal valve 152 is located at a midpoint along the length of the pup joint 112, the location of the valve can be anywhere inside the pup joint. The pulse signal valve 152 is operable to send and receive signals between pup joints and the surface system 160. The positive pulse signal valve 152 allows the multiple pup joints 112 to communicate with each other. Each pup joint 112 includes an internal pressure sensor and can send a specific pulse signal unique for a pup joint to be activated after completing data transfer to the surface system 160. When the pup joint detects the code, it can start communicating with the surface system 160 and then activate the next pup joint and the cycle continues. The pulse signal eliminates wired communication. In some implementations, instructions for the valve 152 are pre-programmed as part of the pup joint 112. In some implementations, instructions for the valve 152 are sent from the surface system 160. The described sensing configuration of the pup joint 112 can detect and quantify the presence of formation fluids such as gas and crude oil in the wellbore fluids (for example, drilling mud and otherwise) in real-time based on the measured properties of the drilling fluid 118 inside and outside of the drill string 110 at the pup joint 112.

The surface system 160 is connected to the processor 154 in each of the multiple pup joints 112. As discussed above, the connection is typically a series connection with each pup joint passing information to adjacent pup joints until it reaches the surface. More specifically, the information is passed to the surface by each pup joint and each pup joint activates the next pup joint to pass its information to surface. As part of drilling/rig automation, the surface system 160 is configured to update a drilling plan, and to change (e.g., increase) the weight of the mud pumped into a wellbore 106. The surface system 160 updates the drilling plan in response to the determined kick in the wellbore 106 based on the data received from the processor 154. The larger the difference between sensor measurements between inside the drill pipe and annulus, the higher the mud weight would be increased, until the formation fluid kicks disappears. In some implementations, the processor is a microprocessor-based control system, including input/output devices, a memory that stores executable instructions, and one or more processors operable to execute the stored instructions. The microprocessor-based control system can include one or more components (for example, memory and instructions accessible through a graphical user interface) that are off-premise, such as stored in one or more servers located remotely from the drilling assembly 100. In some implementations, the control system can be electrical, mechanical, electro-mechanical, hydraulic, a combination thereof, or otherwise.

FIGS. 3A-6C are examples of measured properties of the drilling fluid 118 inside and outside of the drill string 110 at the pup joint 112 under different conditions.

Figures 3A, 3B, 3C:
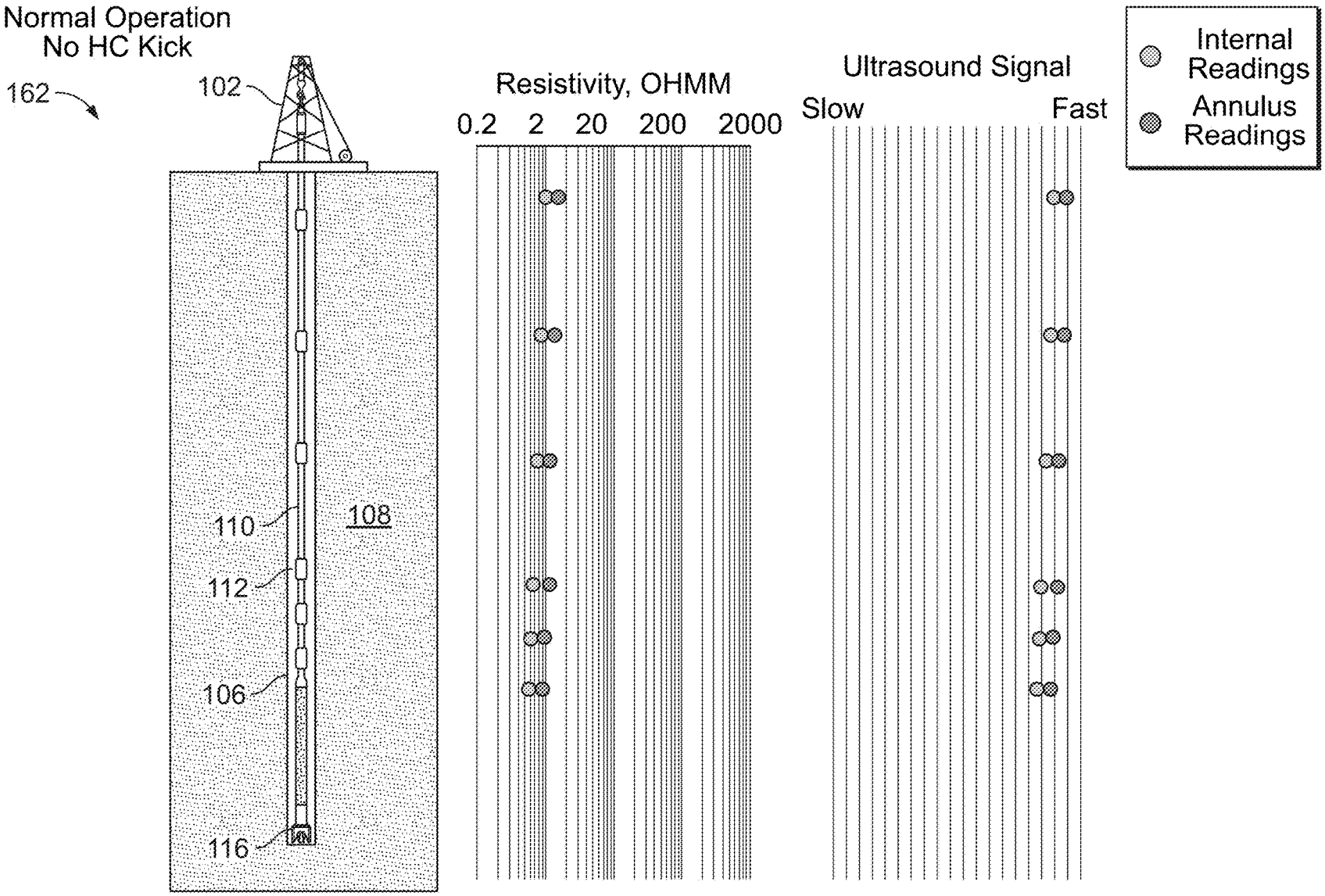

FIGS. 3A-3C illustrate measurements for resistivity and ultrasound signal (e.g., acoustic velocity) of the drilling fluid 118 under normal wellbore conditions. FIG. 3A illustrates a drill string with multiple pup joints as described above. FIGS. 3B and 3C are, respectively, plots of resistivity 162 and ultrasound speed 163 measured by the pup joints. The measurements are collected, using sensor modules 142 and 144 including resistivity and ultrasound sensors, of the drilling fluid 118 inside and outside of the drill string 110 at the pup joint 112. In each measured set, resistivity or ultrasound, the inside and outside measurements are close to each other indicating properties of the drilling fluid 118 inside and outside of the drill string 110 are similar at each of the pup joints, considering the effect of drill cuttings which is always increase readings of resistivity (with WBM drilling) and acoustic sound speed (sound speed of solids is about 4 times faster than that of fluids). This indicates stable wellbore conditions and normal operations.

Figures 4A, 4B, 4C:
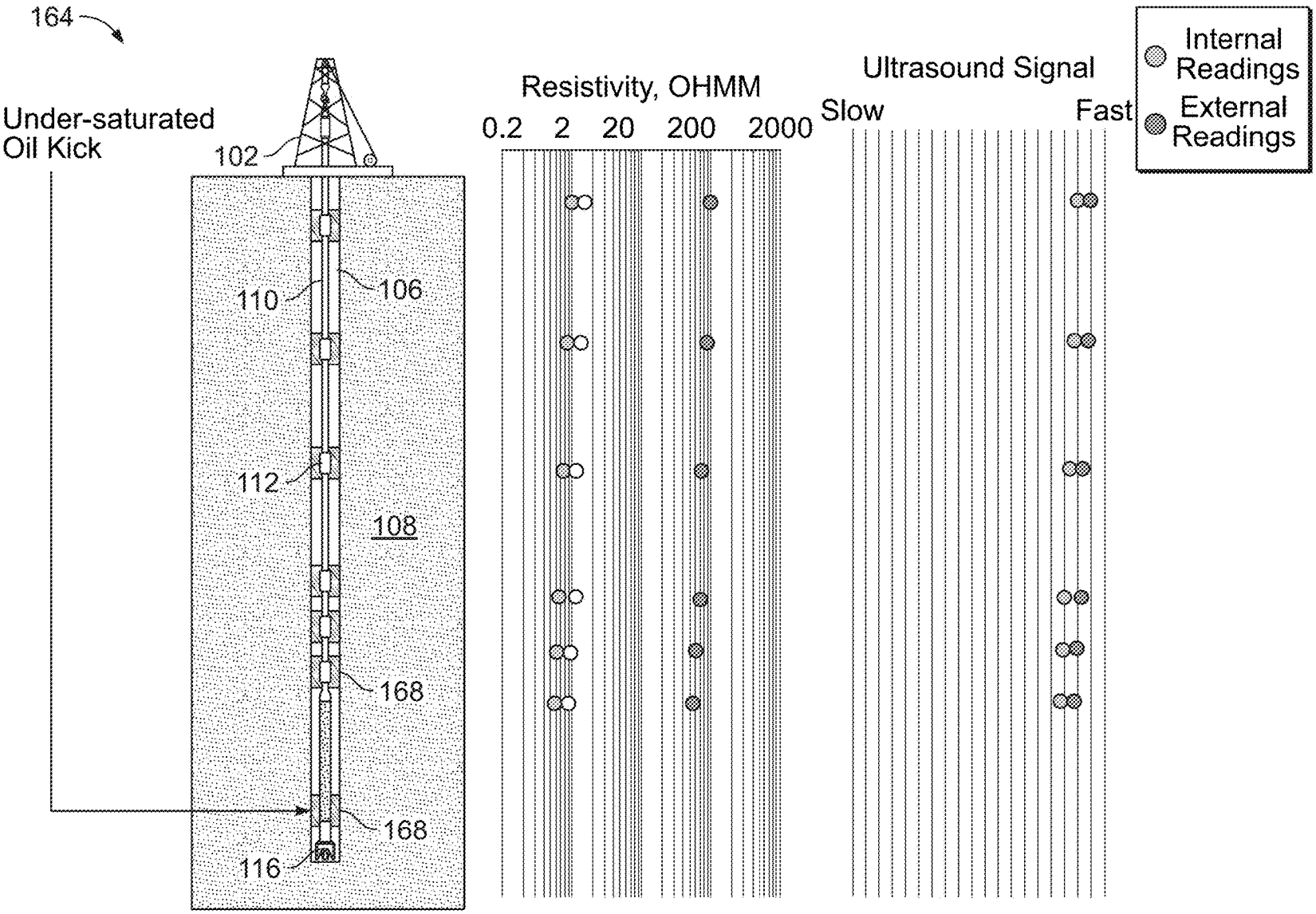

FIGS. 4A-4C illustrate measurements for resistivity and ultrasound signal (e.g., acoustic velocity) of the drilling fluid 118 with under-saturated crude oil kick conditions or environment formed in the wellbore 106 during drilling operations. The measurements are collected, using sensor modules 142 and 144 including resistivity and ultrasound sensors, of the drilling fluid 118 (e.g., water-based mud) inside and outside of the drill string 110 at the pup joint 112. In this example, there is not a significant difference between the sound velocity of the drilling fluid inside and outside of the drill string 110 at the pup joint 112 because the sound velocities of water (about 4,600-5,300 ft/s) and oil (about 4,200 ft/s) are not drastically different. However, the resistivity of drilling fluid rises with the presence of oil. Here, sensors indicate an increase of the resistivity in the drilling fluid 118 on the outside of the pup joint. This is a result of the under-saturated crude oil kick formed in a wellbore during drilling operations.

Figures 5A, 5B, 5C:
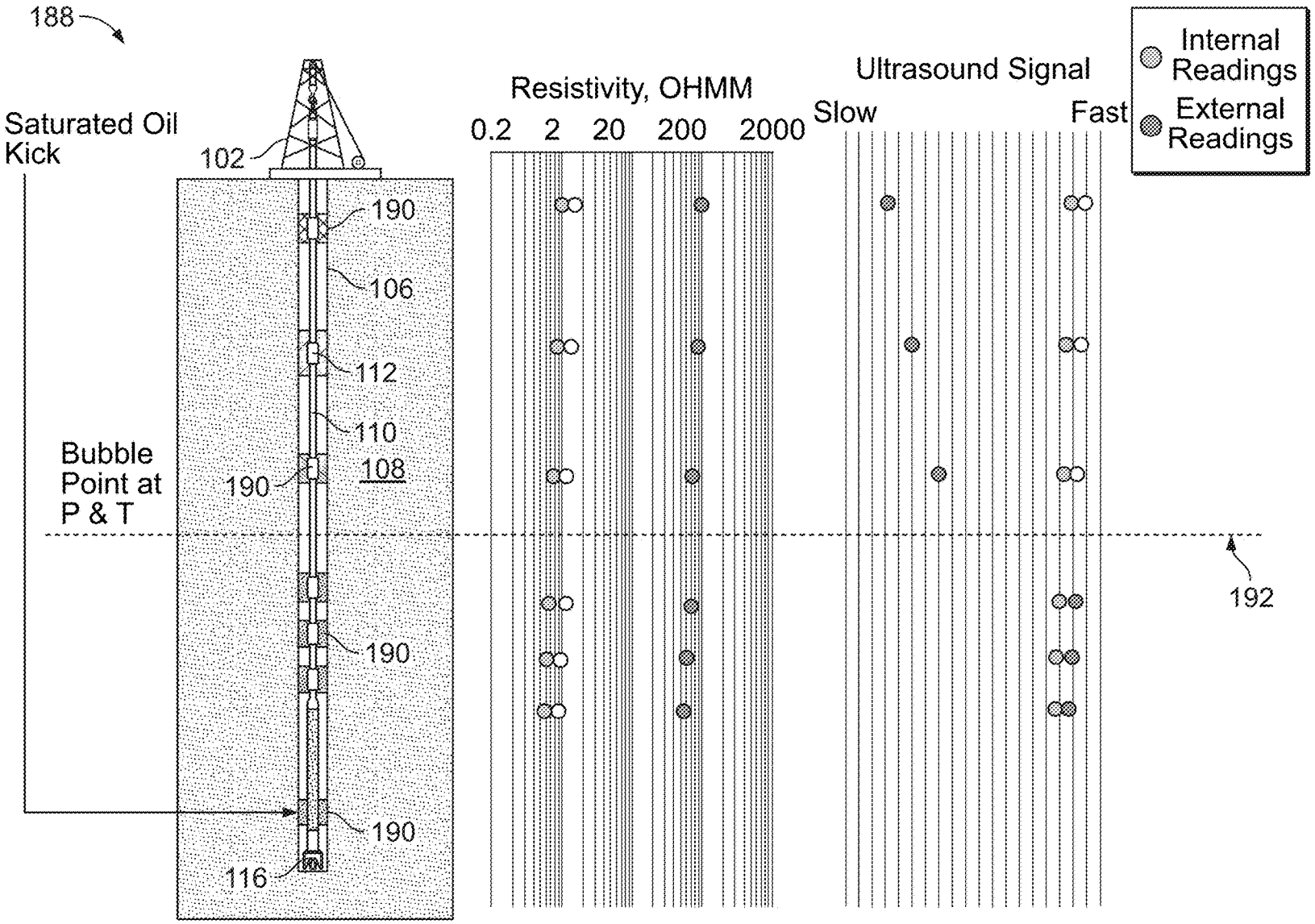

FIGS. 5A-5C illustrate measurements for resistivity and ultrasound signal (e.g., acoustic velocity) of the drilling fluid 118 with saturated crude oil kick formed in the wellbore 106 during drilling operations. In the event of a saturated crude oil kick, oil tends to be present in the drilling fluid throughout the annulus but bubbles of gas form within the drilling fluid above a bubble point depth 192 whose location is a function of pressure and temperature in the wellbore. The measurements are collected, using sensor modules 142 and 144 including resistivity and ultrasound sensors, of the drilling fluid 118 (e.g., water-based mud) inside and outside of the drill string 110 at the pup joint 112. In this example, the resistivity sensors indicate an increase of the resistivity in the drilling fluid 118 on the outside of the pup joint as a result of the saturated crude oil kick 190 formed in the wellbore 106 during drilling operations. On the other hand, the ultrasonic sensor starts to detect the kick above the bubble point depth 192, and pressure, temperature, and gas bubbles start to appear. As the kick moves up the wellbore 106 to lower pressure and temperature regions, more gas bubbles are evolving which results in a lower fluid density in the annulus and slower sound velocity (i.e., the dark gray circles move from right to left indicating a decrease in the sound velocity or the ultrasound signal, for acoustic sound velocity is very sensitive to gas, which is about 4 times less than liquid and about 20 times less than rock solids, depending on pressure). The speed of sound in the drilling fluid can be slow also before a solid settlement event (e.g., when solid particles such as barite settle at the deviated and horizontal section of the wellbore). In some examples, as the solid concentration increases absence of a received sound signal is also likely.

Figures 6A, 6B, 6C:
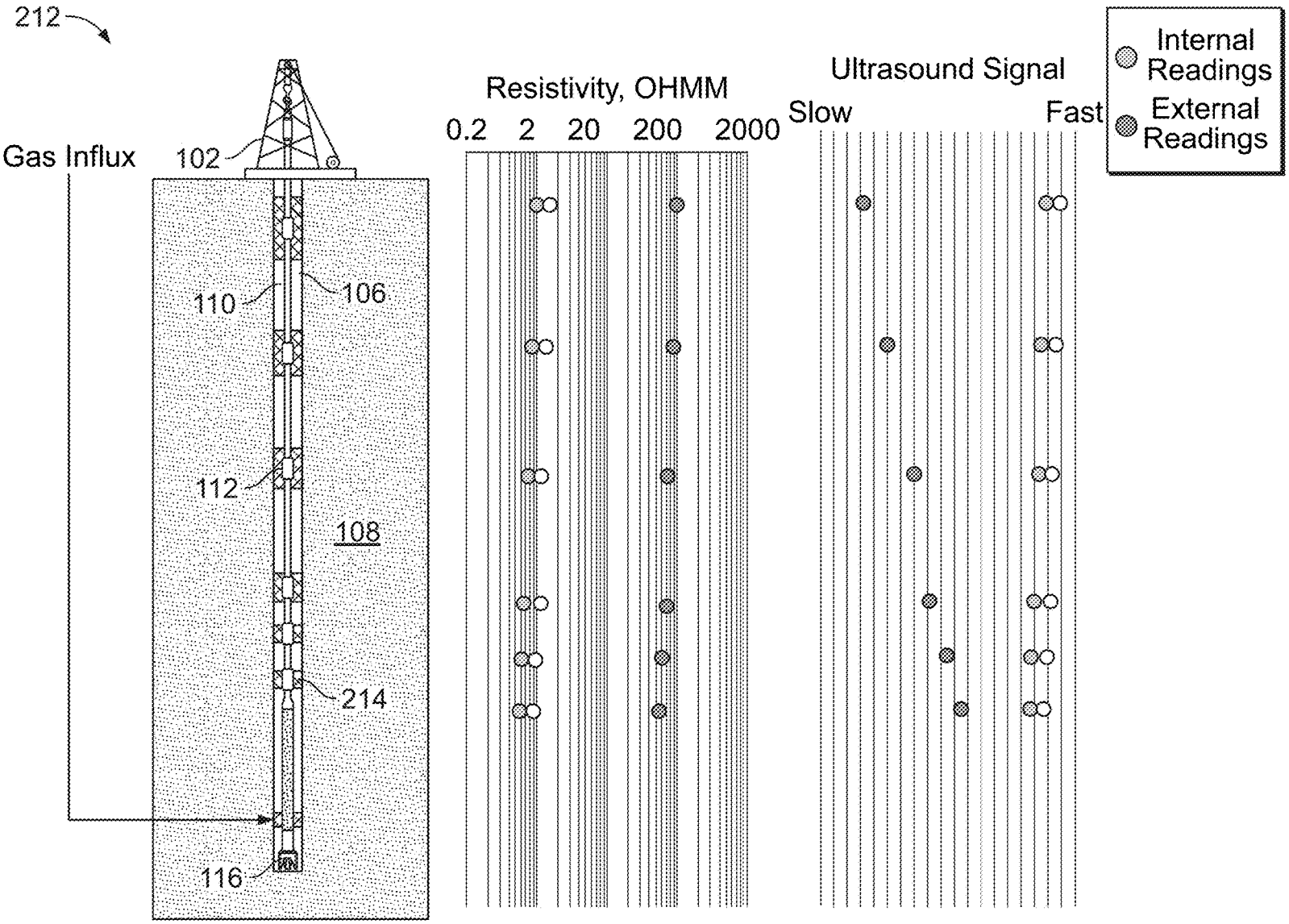

FIGS. 6A-6C illustrate measurements for resistivity and ultrasound signal (e.g., velocity) of the drilling fluid 118 with a gas influx kick formed in the wellbore 106 during drilling operations. The measurements are collected using sensor modules 142 and 144, including resistivity and ultrasound sensors, of the drilling fluid 118 (e.g., water-based mud) inside and outside of the drill string 110 at the pup joint 112. In this example, the gas expands as it moves to lower pressure and temperature regions, and both resistivity and ultrasonic sensors can detect the change in properties of the drilling fluid. This example shows when a gas kick is present, the measurements between the inside and the outside of the pup joint can be dramatically different, such as the external sound speed drops dramatically in fluids full of gas bubbles as sound travels much slower in gases than liquids. As to be noticed in chart 212, the received ultrasound signals weaken due to the gas and liquid mixture indicating a gas kick in the wellbore 106. Also, the resistivity sensors indicate an increase of the resistivity in the drilling fluid 118 on the outside of the pup joint as a result of the gas kick 214 formed in the wellbore 106 during drilling operations.

Figure 7:
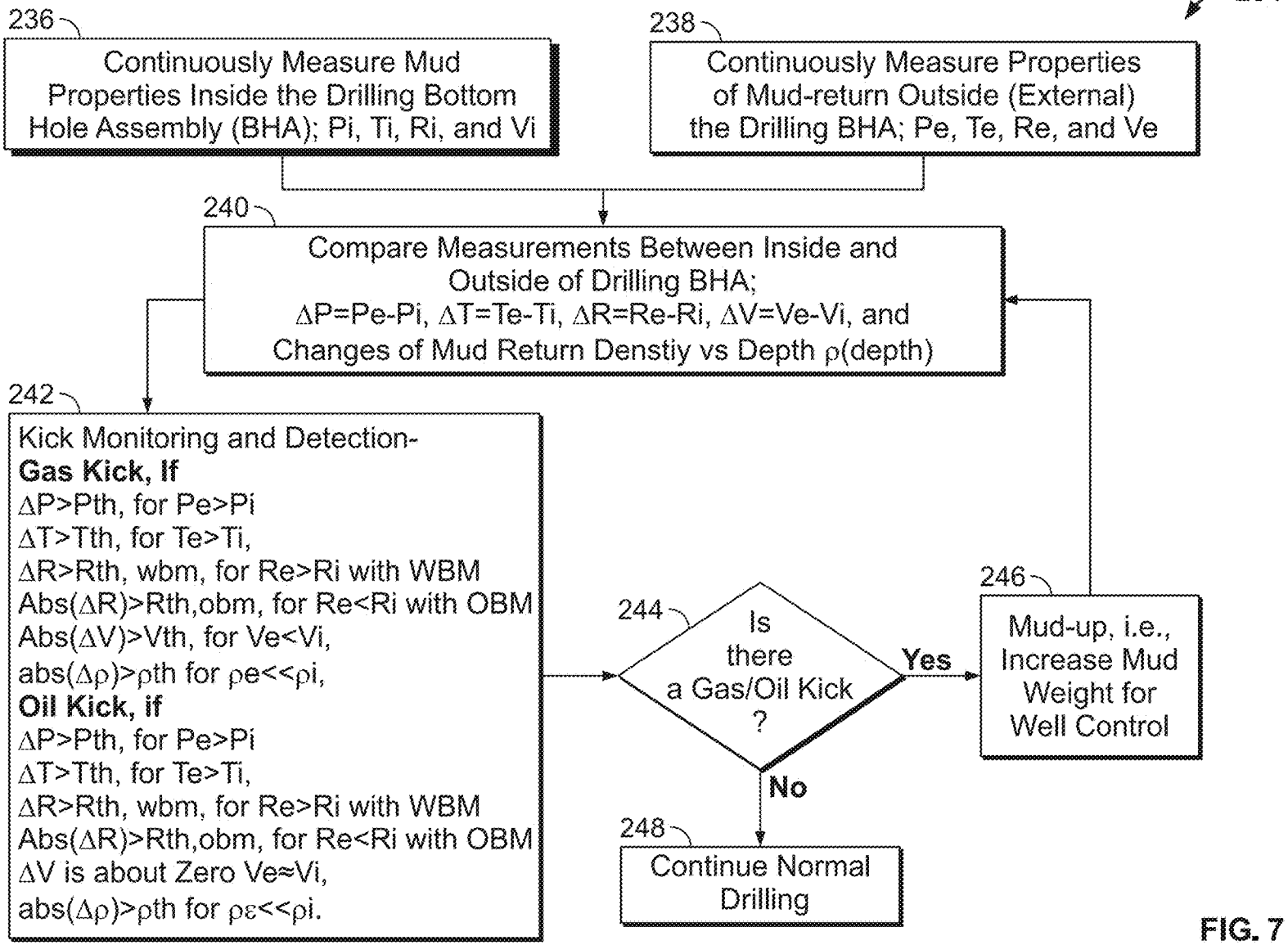
FIG. 7 is a flowchart showing a workflow for determining a kick in a wellbore.

FIG. 7 is a flowchart showing a workflow 234 for determining when a kick has occurred in a wellbore 106. During drilling operations, a drill string 110, with a pup joint 112 carrying the first sensor module 144 and the second module 142, is deployed into a subsurface formation to form a wellbore 106. The first sensor module 144 continuously measures the properties of the drilling fluid 118 inside of the drill string 110 at the pup joint 112 (e.g., internal properties). The properties of the drilling fluid 118 inside the drill string 110 at the pup joint include pressure, temperature, resistivity, dielectric constant, and acoustic velocity measured using a first pressure, a first temperature, a first resistivity, a first dielectric constant, and a first ultrasound sensor (236). The second sensor module 142 continuously measures the properties of the drilling fluid 118 outside of the drill string 110 at the pup joint 112 (e.g., external properties). The properties of the drilling fluid 118 outside of the drill string 110 at the pup joint include pressure, temperature, resistivity, dielectric constant, and velocity measured using a second pressure, a second temperature, a second resistivity, a second dielectric constant, and a second ultrasound sensor (238). The processor 154 calculates a difference between the properties of the drilling fluid 118 inside and outside of the drill string 110 at the pup joint 112 (240). For example, a difference (Δ) in pressure (P) between external pressure ($P_e$) and internal pressure ($P_i$) (e.g., $\Delta P=P_e-P_i$), in temperature (T) between external temperature ($T_e$) and internal temperature ($T_i$) (e.g., $\Delta T=T_e-T_i$), in resistivity (R) between external resistivity ($R_e$) and internal resistivity ($R_i$) (e.g., $\Delta R=R_e-R_i$), in acoustic velocity (V) between external velocity ($V_e$) and internal velocity ($V_i$) (e.g., $\Delta V=V_e-V_i$), and mud return density (ρ) between external mud density ($\rho_e$) and internal mud density ($\rho_i$) (e.g., $\Delta\rho=\rho_e-\rho_i$). These values are compared to corresponding threshold values (e.g., $P_{th}$, $T_{th}$, $R_{th}$, $V_{th}$, or $\rho_{th}$) pre-determined within a program for a kick occurrence detection and monitoring defined within the processor 154 by a user (242).

The kick occurrence detection and monitoring program includes a suite of parameter-based commands that correspond to a detection of a gas kick, a crude oil kick, a hot water kick in case of drilling geothermal wells, or all of the above. In some implementations, the crude oil kick is saturated, an under-saturated crude oil kick, or both. In an event when the pre-determined threshold values are reached or cross the processor 154, it determines the difference between the properties of the drilling fluid 118 inside and outside of the pup joint 112, exceeding the pre-determined threshold values and sends warning signs to the surface system 160 (e.g., electronic control and processing system) via the communication device 150. In some implementations, multiple measurements (e.g., of the same portion of the drilling fluid or different portions of the drilling fluid) are collected and averaged according to a pre-determined schedule (e.g., one measurement per minute or otherwise). The average value can be a representative of the fluid resistivity or acoustic speed of the drilling fluid for a particular depth, location of the wellbore, or for a particular instant or time duration of the wellbore operation. In some implementations, standard deviations of the measurements are determined.

Using the values obtained in this workflow, the described systems and methods additionally aim to determine the occurrence of the kick and the type of kick that can be used to update the drilling plan for wellbore operation. For example, a gas kick is determined in the wellbore when a pressure difference between the pressure of the drilling fluid inside and outside of the drill string at the pup joint is greater than a pre-determined pressure threshold value, or pressure changes inside and outside of the drill string at the pup joint is greater than a pre-determined pressure threshold value. A gas kick is determined in the wellbore when a temperature difference between the temperature of the drilling fluid inside and outside of the drill string at the pup joint is greater than a pre-determined temperature threshold value. This is calculated for the temperature of the drilling fluid outside of the drill string being greater (or hotter) than the temperature of the drilling fluid inside of the drill string. A gas kick is determined in the wellbore also when a resistivity difference between the resistivity of the drilling fluid inside and outside of the drill string at the pup joint is greater than a pre-determined resistivity threshold value. This is calculated for the resistivity of the drilling fluid outside of the drill string being greater than the resistivity of the drilling fluid inside of the drill string. The drilling fluid being water-based mud.

The gas kick is determined in the wellbore also when an absolute value of a resistivity difference between the resistivity of the drilling fluid inside and outside of the drill string at the pup joint is greater than the pre-determined resistivity threshold value. This is calculated for the resistivity of the drilling fluid outside of the drill string being approaching to the resistivity of the drilling fluid inside of the drill string, with the drilling fluid being an oil-based mud. The gas kick is determined in the wellbore also when an absolute value of an acoustic velocity difference between the velocity of the drilling fluid inside and outside of the drill string at the pup joint is greater than a pre-determined velocity threshold value. This is calculated for the velocity of the drilling fluid outside of the drill string being less than the velocity of the drilling fluid inside of the drill string. The gas kick is determined when an absolute value of a density difference between the density of the drilling fluid inside and outside of the drill string at the pup joint is greater than a pre-determined density threshold value. This is calculated for the density of the drilling fluid outside of the drill string being less than the density of the drilling fluid inside of the drill string.

A crude oil kick can be determined in the wellbore when a pressure difference between the pressure of the drilling fluid inside and outside of the drill string at the pup joint is greater than a pre-determined pressure threshold value, or pressure changes of the drilling fluid inside and outside of the drill string at the pup joint is greater than a pre-determined pressure threshold value. The crude oil kick can be determined also when a temperature difference between the temperature of the drilling fluid inside and outside of the drill string at the pup joint is greater than a pre-determined temperature threshold value. This is calculated for the temperature of the drilling fluid outside of the drill string being greater than the temperature of the drilling fluid inside of the drill string. The crude oil kick is determined in the wellbore also when a resistivity difference between the resistivity of the drilling fluid inside and outside of the drill string at the pup joint is greater than a pre-determined resistivity threshold value. This is calculated for the resistivity of the drilling fluid outside of the drill string being greater than the resistivity of the drilling fluid inside of the drill string with the drilling fluid being a water-based mud.

The crude oil kick is determined in the wellbore also when an absolute value of a resistivity difference between the resistivity of the drilling fluid inside and outside of the drill string at the pup joint is greater than the pre-determined resistivity threshold value. This is calculated for the resistivity of the drilling fluid outside of the drill string being similar to the resistivity of the drilling fluid inside of the drill string with the drilling fluid being an oil-based mud. The crude oil kick is determined in the wellbore also when an acoustic velocity difference between the velocity of the drilling fluid inside and outside of the drill string at the pup joint is approaching zero for the velocity of the drilling fluid outside of the drill string being almost equal with the velocity of the drilling fluid inside of the drill string. The crude oil kick is also determined when an absolute value of a density difference between the density of the drilling fluid inside and outside of the drill string at the pup joint is greater than a pre-determined density threshold value. This is calculated for the density of the drilling fluid outside of the drill string being smaller than the density of the drilling fluid inside of the drill string, due to the influx of crude oil is lighter than WBM.

The drill string includes multiple pup joints and the determined occurrence of the kick (e.g., gas, crude oil (saturated, under-saturated) kick, or combinations thereof) is based on the difference between the properties of the drilling fluid inside and outside of the drill string exceeding the pre-determined threshold values at the plurality of the pup joints. When at least two or three pre-determined threshold values are reached or crossed for consecutive pup joints, a kick is likely confirmed (244). For example, when for two consecutive pup joints the pre-determined threshold values are slightly crossed (e.g., within 5% from the threshold value ($R_{th}$ or $V_{th}$)), the system 160 will send an alert signal to the operator or driller. In another example, when for two consecutive pup joints the pre-determined threshold values are significantly crossed (e.g., 10% from the threshold value ($R_{th}$ or $V_{th}$)), the system 160 will send a yellow alert signal to the operator or driller. In another example, when for three consecutive pup joints the pre-determined threshold values are largely crossed (e.g., 20% from the threshold value $R_{th}$ or $V_{th}$)), the system 160 will send a red alert signal to the operator or driller to execute an action. In some implementations, each measurement is communicated in real-time (e.g., after the measurement is taken without delay or with negligible delay) with the surface system 160. In some implementations, measurements are taken in a particular cycle (e.g., in a particular time duration or once a specified amount of measured data in bits is collected) and are then communicated to the surface system 160 for the action to be executed.

The action can include updating the drilling plan defined within the electronic control and processing system by changing (e.g., increasing) the type, composition, or weight of the mud pumped into the wellbore upon the determined kick in the wellbore (246). In the event when the kick is not determined within the wellbore, the normal drilling operations continue (248). In some implementations, the system can have additional criteria when two consecutive pup joints cross the pre-determined threshold values based on the pressure and temperature properties of the drilling fluid. These properties are expected to increase with respect to a depth within the wellbore, indicating a dramatic change in the properties of the drilling fluid. If a formation pressure increases, the mud density can be increased to balance the pressure and keep the wellbore stable. The most common weighting material is barite. An unbalanced formation pressure will cause an unexpected influx (e.g., kick) of the formation fluids in the wellbore leading to a blowout. If the hydrostatic pressure is greater than or equal to the formation pressure, the formation fluid will not flow into the wellbore. In some implementations, the system can have additional criteria where two consecutive pup joints detect a material (e.g., barite) sag or cutting bed in a deviated or horizontal section of the wellbore (e.g., as a result of a change in the speed of sound of the drilling fluid before and after solid settlement) and sends alert signals to the operator or driller. Adding additional criteria to the monitoring approach increases the certainty and accuracy in determining the condition of the wellbore. Well control leads to the absence of an uncontrollable flow of formation fluids into the wellbore.

Figure 8:
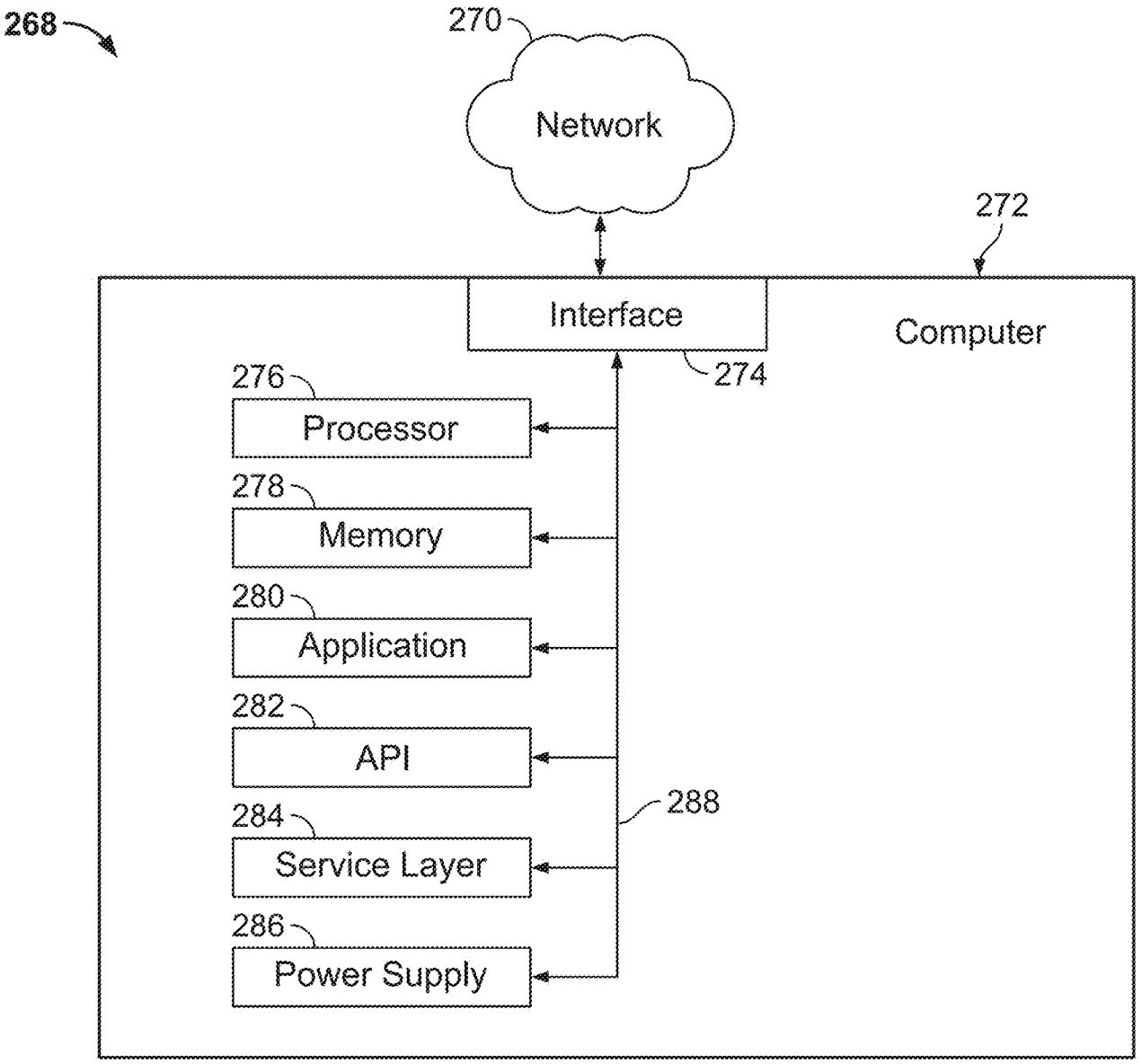
FIG. 8 is a block diagram of an example computer system.

FIG. 8 is a block diagram of an example computer system 268 used to provide computational functionalities associated with described algorithms, methods, functions, processes, flows, and procedures described in the present disclosure, according to some implementations of the present disclosure. The illustrated computer 272 is intended to encompass any computing device such as a server, a desktop computer, a laptop/notebook computer, a wireless data port, a smartphone, a personal data assistant (PDA), a tablet computing device, or one or more processors within these devices, including physical instances, virtual instances, or both. The computer 272 can include input devices such as keypads, keyboards, and touch screens that can accept user information. Also, the computer 272 can include output devices that can convey information associated with the operation of the computer 272. The information can include digital data, visual data, audio information, or a combination of information. The information can be presented in a graphical user interface (UI) (or GUI).

The computer 272 can serve in a role as a client, a network component, a server, a database, a persistency, or components of a computer system for performing the subject matter described in the present disclosure. The illustrated computer 272 is communicably coupled with a network 270. In some implementations, one or more components of the computer 272 can be configured to operate within different environments, including cloud-computing-based environments, local environments, global environments, and combinations of environments.

At a high level, the computer 272 is an electronic computing device operable to receive, transmit, process, store, and manage data and information associated with the described subject matter. According to some implementations, the computer 272 can also include, or be communicably coupled with, an application server, an email server, a web server, a caching server, a streaming data server, or a combination of servers.

The computer 272 can receive requests over network 270 from a client application (for example, executing on another computer 272). The computer 272 can respond to the received requests by processing the received requests using software applications. Requests can also be sent to the computer 272 from internal users (for example, from a command console), external (or third) parties, automated applications, entities, individuals, systems, and computers. Each of the components of the computer 272 can communicate using a system bus 288. In some implementations, any or all of the components of the computer 272, including hardware or software components, can interface with each other or the interface 274 (or a combination of both), over the system bus 288. Interfaces can use an application programming interface (API) 282, a service layer 284, or a combination of the API 282 and service layer 284. The API 282 can include specifications for routines, data structures, and object classes. The API 282 can be either computer-language independent or dependent. The API 282 can refer to a complete interface, a single function, or a set of APIs.

The service layer 284 can provide software services to the computer 272 and other components (whether illustrated or not) that are communicably coupled to the computer 272. The functionality of the computer 272 can be accessible for all service consumers using this service layer. Software services, such as those provided by the service layer 284, can provide reusable, defined functionalities through a defined interface. For example, the interface can be software written in JAVA, C++, or a language providing data in extensible markup language (XML) format. While illustrated as an integrated component of the computer 272, in alternative implementations, the API 282 or the service layer 284 can be stand-alone components in relation to other components of the computer 272 and other components communicably coupled to the computer 272. Moreover, any or all parts of the API 282 or the service layer 284 can be implemented as child or sub-modules of another software module, enterprise application, or hardware module without departing from the scope of the present disclosure.

The computer 272 includes an interface 274. Although illustrated as a single interface 274 in FIG. 8, two or more interfaces 274 can be used according to particular needs, desires, or particular implementations of the computer 272 and the described functionality. The interface 274 can be used by the computer 272 for communicating with other systems that are connected to the network 270 (whether illustrated or not) in a distributed environment. Generally, the interface 274 can include, or be implemented using, logic encoded in software or hardware (or a combination of software and hardware) operable to communicate with the network 270. More specifically, the interface 274 can include software supporting one or more communication protocols associated with communications. As such, the network 270 or the interface's hardware can be operable to communicate physical signals within and outside of the illustrated computer 272.

The computer 272 includes a processor 276. Although illustrated as a single processor 276 in FIG. 8, two or more processors 276 can be used according to particular needs, desires, or particular implementations of the computer 272 and the described functionality. Generally, the processor 276 can execute instructions and can manipulate data to perform the operations of the computer 272, including operations using algorithms, methods, functions, processes, flows, and procedures as described in the present disclosure.

The computer 272 also includes a database (not shown) that can hold data for the computer 272 and other components connected to the network 270 (whether illustrated or not). For example, database (not shown) can be an in-memory, conventional, or a database storing data consistent with the present disclosure. In some implementations, database (not shown) can be a combination of two or more different database types (for example, hybrid in-memory and conventional databases) according to particular needs, desires, or particular implementations of the computer 272 and the described functionality. Although illustrated as a single database (not shown) in FIG. 8, two or more databases (of the same, different, or combination of types) can be used according to particular needs, desires, or particular implementations of the computer 272 and the described functionality. While database (not shown) is illustrated as an internal component of the computer 272, in alternative implementations, database (not shown) can be external to the computer 272.

The computer 272 also includes a memory 278 that can hold data for the computer 272 or a combination of components connected to the network 270 (whether illustrated or not). Memory 278 can store any data consistent with the present disclosure. In some implementations, memory 278 can be a combination of two or more different types of memory (for example, a combination of semiconductor and magnetic storage) according to particular needs, desires, or particular implementations of the computer 272 and the described functionality. Although illustrated as a single memory 278 in FIG. 8, two or more memories 278 (of the same, different, or combination of types) can be used according to particular needs, desires, or particular implementations of the computer 272 and the described functionality. While memory 278 is illustrated as an internal component of the computer 272, in alternative implementations, memory 278 can be external to the computer 272.

The application 280 can be an algorithmic software engine providing functionality according to particular needs, desires, or particular implementations of the computer 272 and the described functionality. For example, application 280 can serve as one or more components, modules, or applications. Further, although illustrated as a single application 280, the application 280 can be implemented as multiple applications 280 on the computer 272. In addition, although illustrated as internal to the computer 272, in alternative implementations, the application 280 can be external to the computer 272.

The computer 272 can also include a power supply 286. The power supply 286 can include a rechargeable or non-rechargeable battery that can be configured to be either user- or non-user-replaceable. In some implementations, the power supply 286 can include power-conversion and management circuits, including recharging, standby, and power management functionalities. In some implementations, the power-supply 286 can include a power plug to allow the computer 272 to be plugged into a wall socket or a power source to, for example, power the computer 272 or recharge a rechargeable battery.

There can be any number of computers 272 associated with, or external to, a computer system containing computer 272, with each computer 272 communicating over network 270. Further, the terms "client," "user," and other appropriate terminology can be used interchangeably, as appropriate, without departing from the scope of the present disclosure. Moreover, the present disclosure contemplates that many users can use one computer 272 and one user can use multiple computers 272.

Implementations of the subject matter and the functional operations described in this specification can be implemented in digital electronic circuitry, intangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially-generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of these systems and methods have been described. Nevertheless, it will be understood that various modifications may be made without departing from the spirit and scope of this disclosure. Accordingly, other embodiments are within the scope of the following claims.

What is claimed:

1. A method for detecting a formation fluid kick in a wellbore, the method comprising:

drilling into a subsurface formation using a drill string including a pup joint;

measuring properties of a drilling fluid inside of the drill string at the pup joint using a first sensor module;

measuring properties of the drilling fluid outside of the drill string at the pup joint using a second sensor module;

analyzing measured properties of the drilling fluid inside and also outside of the drill string at the pup joint;

calculating a difference between the properties of the drilling fluid inside and outside of the drill string at the pup joint;

determining an occurrence of the formation fluid kick based on the analysis of pressure and temperature of the drilling fluid inside and outside of the drill string at the pup joint and the difference between the temperature of the drilling fluid inside and outside of the drill string at the pup joint exceeding a pre-determined threshold value for the difference between the temperature of the drilling fluid outside of the drill string and the temperature of the drilling fluid inside of the drill string; and increasing a mud weight of the drilling fluid pumped into the wellbore responsive to the determined kick in the wellbore.

2. The method of claim 1, further comprising transmitting data of the determined kick in the wellbore uphole to a surface system for controlling drilling operations.

3. The method of claim 1, wherein the drill string includes a plurality of pup joints, and determining the occurrence of the formation fluid kick comprises determining the occurrence of the formation fluid kick based on the measured properties of the drilling fluid inside and outside of the drill string exceeding the pre-determined threshold value at the plurality of the pup joints.

4. The method of claim 1, further comprising calculating a difference of a mud return density at each depth from a plurality of depths taken from an Earth's surface to a bottom of the wellbore.

5. The method of claim 4, further comprising comparing the difference between mud return densities at each depth with a pre-determined density threshold value.

6. The method of claim 1, wherein the first sensor module includes a first resistivity sensor and the second sensor module includes a second resistivity sensor, and measuring properties of the drilling fluid comprises measuring resistivity of the drilling fluid inside or outside of the drill string at the pup joint using the first resistivity sensor or the second resistivity sensor.

7. The method of claim 6, wherein the first sensor module further includes a first dielectric constant sensor and the second sensor module further includes a second dielectric constant sensor, and measuring properties of the drilling fluid comprises measuring dielectric constant of the drilling fluid inside or outside of the drill string at the pup joint using the first dielectric constant sensor or the second dielectric constant sensor.

8. The method of claim 1, wherein the first sensor module includes a first ultrasound sensor and the second sensor module includes a second ultrasound sensor, wherein measuring properties of the drilling fluid comprises measuring acoustic velocity of the drilling fluid inside or outside of the drill string at the pup joint using the first ultrasound sensor or the second ultrasound sensor.

9. The method of claim 1, wherein measuring properties of the drilling fluid comprises measuring resistivity and acoustic velocity of the drilling fluid inside or outside of the drill string at the pup joint.

10. The method of claim 1, wherein determining the occurrence of the formation fluid kick comprises determining the formation fluid kick is a gas kick in the wellbore by analyzing the pressure of the drilling fluid inside and outside of the drill string at the pup joint, and when a temperature difference between the temperature of the drilling fluid inside and outside of the drill string at the pup joint is greater than a gas kick pre-determined temperature threshold value for the difference between the temperature of the drilling fluid outside of the drill string and the temperature of the drilling fluid inside of the drill string.

11. The method of claim 10, wherein determining the occurrence of the formation fluid kick comprises determining the gas kick in the wellbore when a resistivity difference between a resistivity of the drilling fluid inside and outside of the drill string at the pup joint is greater than a pre-determined resistivity threshold value for the difference between the resistivity of the drilling fluid outside of the drill string and the resistivity of the drilling fluid inside of the drill string, wherein the drilling fluid is a water-based mud.

12. The method of claim 11, wherein determining the occurrence of the formation fluid kick comprises determining the gas kick in the wellbore when an absolute value of the resistivity difference between the resistivity of the drilling fluid inside and outside of the drill string at the pup joint is approaching to zero, wherein the drilling fluid is an oil-based mud.

13. The method of claim 10, wherein determining the occurrence of the formation fluid kick comprises determining the gas kick in the wellbore when an absolute value of an acoustic velocity difference between an acoustic velocity of the drilling fluid inside and outside of the drill string at the pup joint is greater than a pre-determined velocity threshold value for the acoustic velocity of the drilling fluid outside of the drill string and the acoustic velocity of the drilling fluid inside of the drill string, and an absolute value of a density difference between a density of the drilling fluid inside and outside of the drill string at the pup joint greater than a pre-determined density threshold value for the density of the drilling fluid outside of the drill string and the density of the drilling fluid inside of the drill string.

14. The method of claim 1, wherein determining the occurrence of the formation fluid kick comprises determining the formation fluid kick is a crude oil kick in the wellbore by analyzing the pressure of the drilling fluid inside and outside of the drill string at the pup joint, and when a temperature difference between the temperature of the drilling fluid inside and outside of the drill string at the pup joint is greater than a crude oil kick pre-determined temperature threshold value for the difference in the temperature of the drilling fluid outside of the drill string and the temperature of the drilling fluid inside of the drill string.

15. The method of claim 14, wherein determining the occurrence of the formation fluid kick comprises determining the crude oil kick in the wellbore when a resistivity difference between a resistivity of the drilling fluid inside and outside of the drill string at the pup joint is greater than a pre-determined resistivity threshold value for the difference between the resistivity of the drilling fluid outside of the drill string and the resistivity of the drilling fluid inside of the drill string, wherein the drilling fluid is a water-based mud.

16. The method of claim 15, wherein determining the occurrence of the formation fluid kick comprises determining the crude oil kick in the wellbore when an absolute value of the resistivity difference between the resistivity of the drilling fluid inside and outside of the drill string at the pup joint is approaching to zero, wherein the drilling fluid is an oil-based mud.

17. The method of claim 14, wherein determining the occurrence of the formation fluid kick comprises determining the crude oil kick in the wellbore when an acoustic velocity difference between an acoustic velocity of the drilling fluid inside and outside of the drill string at the pup joint is approaching zero, and an absolute value of a density difference between a density of the drilling fluid inside and outside of the drill string at the pup joint is greater than a pre-determined density threshold value for the density of the drilling fluid outside of the drill string and the density of the drilling fluid inside of the drill string.

18. The method of claim 14, wherein determining the occurrence of the formation fluid kick in the wellbore comprises determining a saturated crude oil kick or an under-saturated crude oil kick or both.

19. A pup joint comprising:

a body configured to be disposed within a wellbore formed in a subterranean formation and having an inner surface defining a flow passage and an outer surface defining an annulus when positioned in the wellbore;

a first sensor module mounted on the body and operable to measure properties of a drilling fluid inside of the pup joint;

a second sensor module mounted on the body and operable to measure properties of a drilling fluid outside of the pup joint;

a powersource disposed inside the pup joint;

a communication device communicatively connected to the first sensor module and the second sensor module and disposed inside the pup joint; and a processor connected to the communication device and the power source and disposed inside the pup joint, the processor operable to perform:

analyzing the measured properties of the drilling fluid inside and outside of the pup joint;

determining an occurrence of a kick based on the analysis of pressure and temperature of the drilling fluid inside and outside of the pup joint exceeding a pre-determined threshold value for a difference between the temperature of the drilling fluid outside of the pup joint and the temperature of the drilling fluid inside of the pup joint; and increasing a mud weight of the drilling fluid injected into the wellbore responsive to determining the kick in the wellbore.

20. A system for detecting a kick in a wellbore, the system comprising:

a drill string;

a plurality of pup joints attached to the drill string and communicatively coupled to one another using a pulse signal valve, wherein each of the plurality of pup joints comprises:

a body;

a first sensor module embedded within an inner surface of the body and operable to measure properties of a drilling fluid inside of the drill string at the pup joint;

a second sensor module embedded within an outer surface of the body and operable to measure properties of a drilling fluid outside of the drill string at the pup joint;

a powersource;

a communication device communicatively connected to the first sensor module and the second sensor module; and a processor connected to the communication device and the powersource, the processor operable to perform:

analyzing the measured properties of the drilling fluid inside and outside of the drill string at the pup joint;

determining an occurrence of the kick based on the analysis of the pressure and temperature of the drilling fluid inside and outside of the drill string at the pup joint exceeding a pre-determined threshold value for a difference between the temperature of the drilling fluid outside of the drill string and the temperature of the drilling fluid inside of the drill string; and automatically increasing a mud weight of the drilling fluid pumped into the wellbore responsive to determining the kick in the wellbore; and an electronic control and processing system connected to the processor in each of the plurality of pup joints, wherein the electronic control and processing system is configured to update a drilling plan and to change the mud weight of the drilling fluid injected into the wellbore responsive to determining the kick in the wellbore.

* * * * *